United States Patent [19]

Poock et al.

[11] Patent Number: 4,478,014

[45] Date of Patent: Oct. 23, 1984

[54] TELESCOPIC BOOM WITH ANGLED CORNER CONSTRUCTION

[75] Inventors: Darwin N. Poock, Cedar Rapids; Thomas J. Volkmann, Hiawatha, both of Iowa

[73] Assignee: FMC Corporation, Chicago, Ill.

[21] Appl. No.: 330,060

[22] Filed: Dec. 14, 1981

[51] Int. Cl.[3] ..... E04H 12/34

[52] U.S. Cl. ..... 52/115; 52/118; 52/632

[58] Field of Search ..... 52/115, 118, 632

[56] References Cited

U.S. PATENT DOCUMENTS

| | | | |
|---|---|---|---|
| 301,019 | 6/1884 | Teal | 52/118 |
| 2,684,159 | 7/1954 | Oldenkamp | 52/115 |
| 2,763,342 | 9/1956 | French | 189/42 |
| 2,920,725 | 1/1960 | Emmons | 189/11 |
| 3,196,990 | 7/1965 | Handley | 189/23 |
| 3,495,370 | 2/1970 | Halbro et al. | 52/118 X |
| 3,571,991 | 3/1971 | Doocy et al. | 52/40 |
| 3,610,433 | 10/1971 | Milner et al. | 212/46 B |
| 3,708,937 | 1/1973 | Sterner | 52/118 |
| 3,802,136 | 4/1974 | Eiler et al. | 52/115 |
| 3,952,466 | 4/1976 | Spain | 52/632 |
| 3,985,234 | 10/1976 | Jouffray | 212/144 |
| 4,003,168 | 1/1977 | Brady | 52/118 |
| 4,038,794 | 8/1977 | Young | 52/118 X |
| 4,171,597 | 10/1979 | Lester et al. | 52/118 |
| 4,257,201 | 3/1981 | Landolt et al. | 52/632 |
| 4,352,434 | 10/1982 | Poock | 52/632 |
| 4,357,785 | 11/1982 | Eklund | 52/118 X |

*Primary Examiner*—Afred C. Perham

*Attorney, Agent, or Firm*—A. J. Moore; R. C. Kamp; R. B. Megley

[57] ABSTRACT

A telescopic boom is disclosed having a plurality of generally tubular boom sections each having its corners defined by angled corner plates converging upwardly and inwardly at equal angles relative to a central vertical plane containing the longitudinal axes of all boom sections when properly aligned. Boom shoes secured to the outer surfaces and near the inner ends of the angled corner plates of all boom sections except the largest section slidably engaging the adjacent angled corner plates of the next larger boom section; and similar boom shoes secured to the inner surfaces of the angled corner plates near the outer end of all boom sections except the smallest section slidably engaging the outer angled surfaces of the next smaller section. The lower outer shoes and the upper shoes cooperate with their associated angles corner surfaces to define inclined planes which maintain the longitudinal axes of the boom sections horizontally aligned with the vertical plane when the tip section is loaded and is subjected to a side force.

13 Claims, 4 Drawing Figures

TELESCOPIC BOOM WITH ANGLED CORNER CONSTRUCTION

CROSS REFERENCE TO RELATED APPLICATIONS

The present application is related to the following United States applications, which applications are assigned to the assignee of the present invention:

Rathe et al application Ser. No. 293,728 filed on Aug. 17, 1981 and entitled ENTENSIBLE BOOM WITH MANUAL STORED IN BASE.

Rathe application Ser. No. 293,729 filed on Aug. 17, 1981 and entitled COUPLING AND LATCHING MECHANISM FOR EXTENSIBLE BOOM.

Cozad application Ser. No. 293,727 filed on Aug. 17, 1981 and entitled LOW DROOP MULTI-PART PENDANT SUPPORTED BOOM.

BACKGROUND OF THE INVENTION

1. Field of the Invention

The present invention relates to a crane having a multi-section extensible telescopic boom; and more particularly relates to a telescopic boom having angled corner sections with boom shoes slidable in said corner sections.

2. Description of the Prior Art

Conventionally the boom sections of telescopic booms for cranes or the like have been generally rectangular in transverse cross-section. Boom shoes, which are the contacting surfaces between the boom sections, are generally arranged in two sets, one set being disposed between adjacent vertical walls and the other set being disposed between adjacent horizontal walls. Because of the clearance required between the vertical boom walls and the associated side shoes, a horizontal side load applied to the tip of boom will cause the longitudinal axis of the tip section, as well as the axes of all other intermediate sections, to deflect out of alignment with the longitudinal axis of the base section in the direction of application of the side load. This side deflection or "kink" between the several boom sections increases with shoe wear and with multisection booms creates a large tip offset. The tip offset results in offset loading and increased side bending forces being applied to the boom resulting in detrimental side deflecting and stresses.

An additional problem occurs when the boom is swung about its vertical axis with a load suspended therefrom. The swinging action may cause the tip section to shift from one side to the other side of the longitudinal axis of the base section causing the suspended load to swing excessively making it difficult for the operator to accurately control the load and place the load in tight spots when swinging of the boom is required. With clearance between the side shoes and the vertical walls, as is conventional, the offset of the outer boom sections will cause additional side bending loading of the boom. Such side bending loading severely stresses welds or the like in the corners of the boom sections.

In addition to booms that are generally rectangular in cross-section, other boom shapes are known. For example, U.S. Pat. No. 3,708,937 which issued to Sterner on Jan. 9, 1973 discloses a trapezoidal boom section; Eiler et al Pat. No. 3,802,136 which issued on Apr. 9, 1974 discloses truncated triangular boom sections used in interconnected pairs; U.S. Pat. No. 3,985,234 which issued to Jouffray on Oct. 12, 1976 illustrates a boom section with the lower wall being V-shaped; and Lester et al Pat. No. 4,171,597 which issued on Oct. 23, 1979 discloses boom sections having external configurations which are generally octagonal. U.S. Pat. No. 4,257,201 which issued to Landolt et al on Mar. 24, 1981 discloses boom sections having slide pad assemblies that include cylindrical outer surfaces at their corners.

SUMMARY OF THE INVENTION

The telescopic boom of the present invention comprises a plurality of boom sections including a base section and a tip section. Each boom section includes a pair of upper angled corner members and a pair of lower angled corner members which extend substantially the full length of the associated boom sections. Each angled corner member includes a planar shoe contacting plate with an outer surface and an inner surface.

The upper shoe contacting angle corner plates converge upwardly and inwardly at equal but opposite angles relative to a longitudinally extending vertical plane containing the longitudinal axis of each boom section; while the lower angled shoe contacting plates converge downwardly and inwardly at equal but opposite angles relative to said plane. Front boom shoes at the forward end of all of the boom sections except the tip section are secured to the inner surfaces of the associated angle corner plates, and rear boom shoes located near the rear end of all boom sections except the base section are secured to the outer surfaces of the angled corner plates.

When a load is applied to the tip section during operation vertical forces are applied to the boom sections such that the front boom shoes tend to slide up or down the associated converging inclined planar shoe contacting surfaces and the rear boom shoes tend to slide up or down the associated inclined planar shoe contacting surfaces thus maintaining the longitudinal axes of the several boom sections aligned in said vertical plane. When side loadings are now applied to the tip section (whether by wind loads or by swinging of the boom) the horizontal forces between the sections cannot produce any boom offset or "kink" because the side clearance has been taken-up by the action of the shoes moving up or down the angled corners which in effect has "wedged" the sections maintaining the alignment of the boom section axes.

DESCRIPTION OF THE PREFERRED EMBODIMENT

Figure 1:
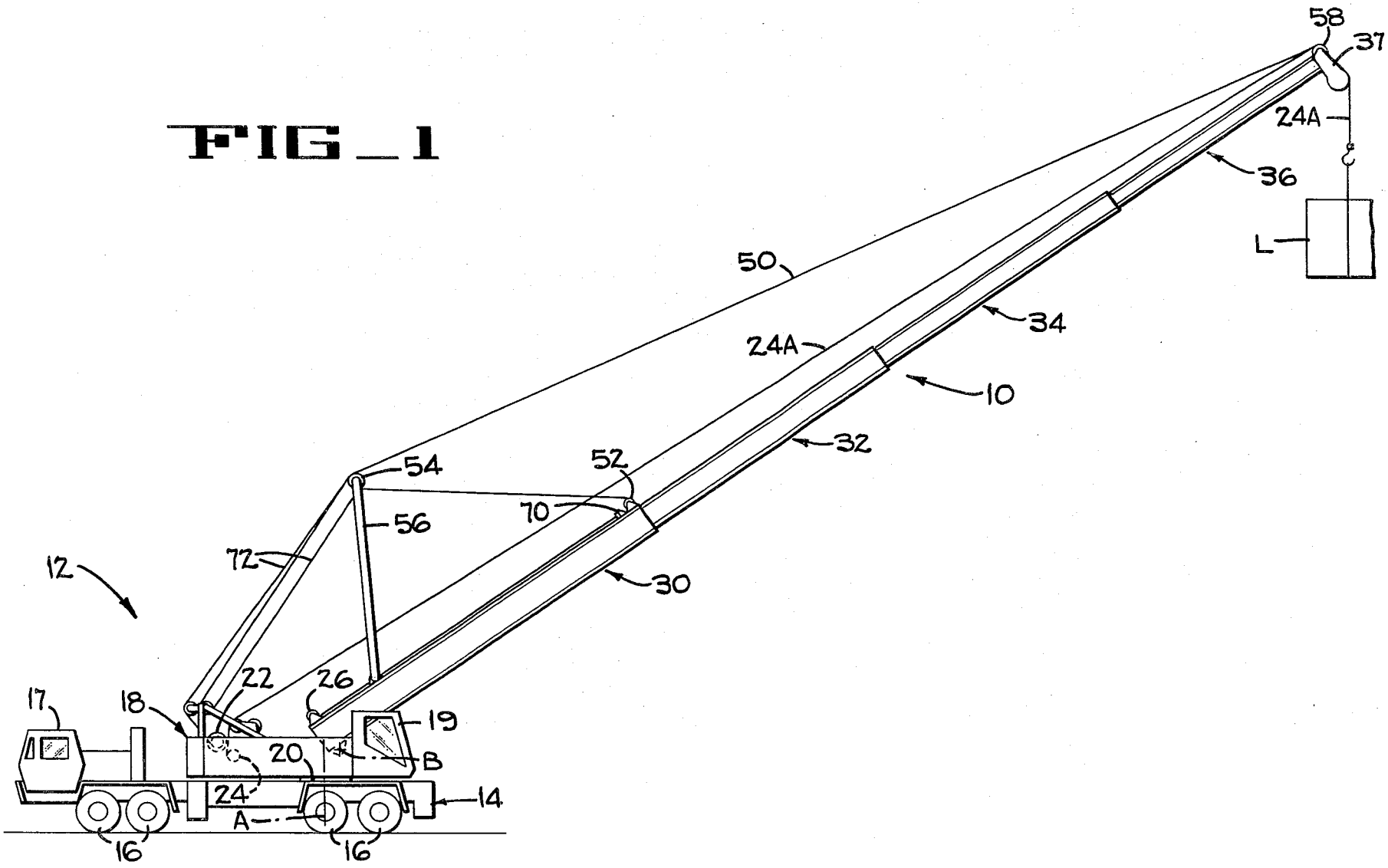
FIG. 1 is a diagrammatic side elevation of the preferred embodiment of a crane which incorporates the telescopic boom of the present invention, the boom being shown fully extended and in an elevated operative position.

The telescopic boom 10 (FIG. 1) with angled corner construction of the present invention is illustrated as a component of a self-propelled truck crane 12 having a lower works or chassis 14 supported on wheels 16 for movement from place to place under the control of an operator in a cab 17. An upper works 18 includes a second cab 19 and is mounted on the chassis by a bearing 20 for rotation about a vertical axis A. The upper works supports the boom for pivotal movement about a horizontal axis B. The upper works 18 also carries power means (not shown) which drives a hydraulic pump (not shown) that provides power to a boom hoist winch or drum 22 (FIG. 1), a load hoist drum 24, one or more pendant take-up drums 26, and other standard components of the crane 12.

In general, the telescopic boom 10 includes at least two sections. However, the boom 10 is preferably a four section boom (FIGS. 1 and 2) which includes a base section 30 pivoted to the upper works about the horizontal axis B, a manual section 32 slidably received within the base section 30, a mid section 34 slidably received in the manual section 32, and a tip section 36 which is slidably received in the mid section 34 and includes head machinery 37 on its outer end for supporting a load L by means of a load line 24*a*.

Figure 2:
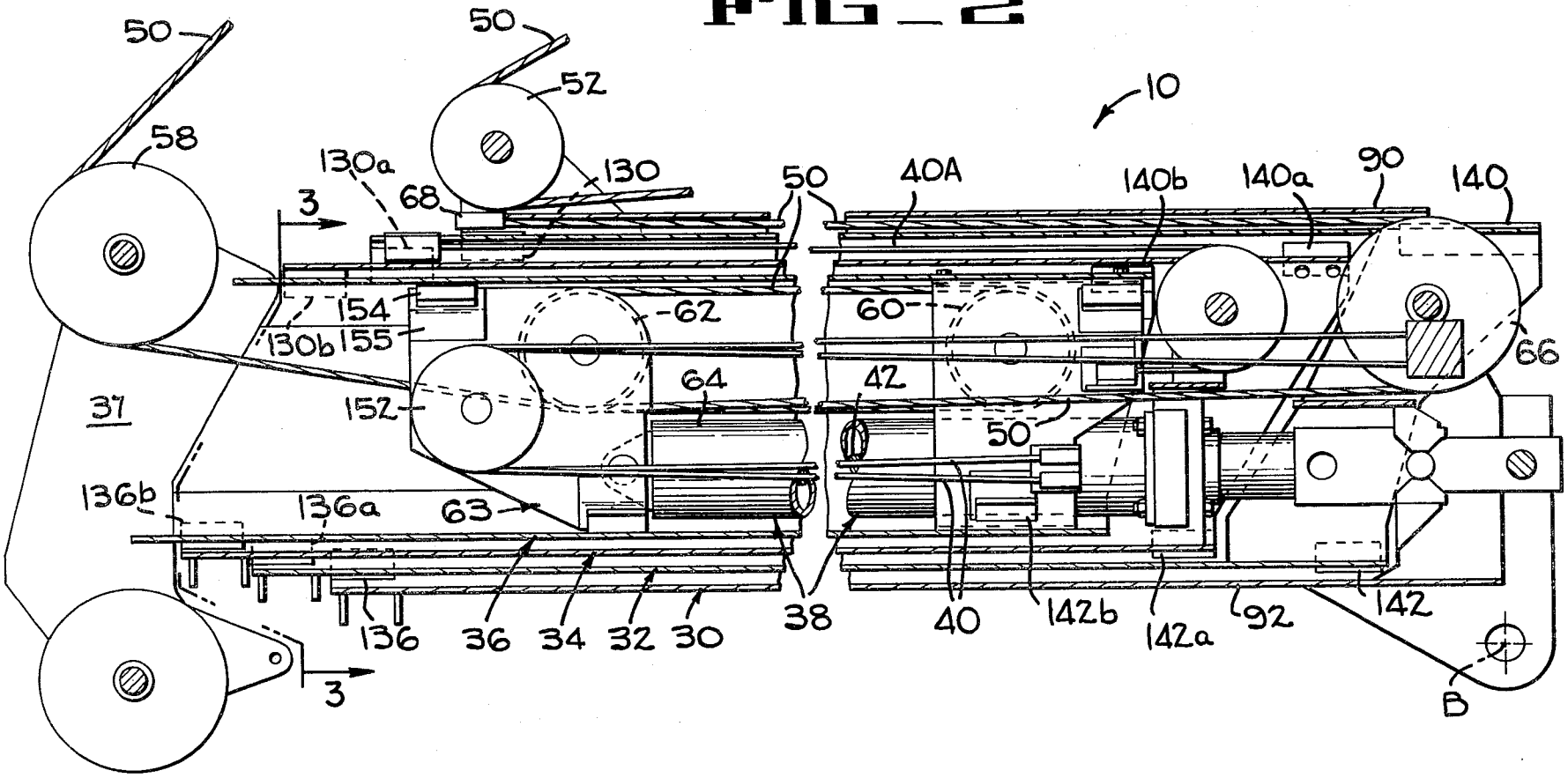
FIG. 2 is a diagrammatic vertical central section of the boom of FIG. 1 with the boom being retracted and positioned horizontally.
Figure 3:
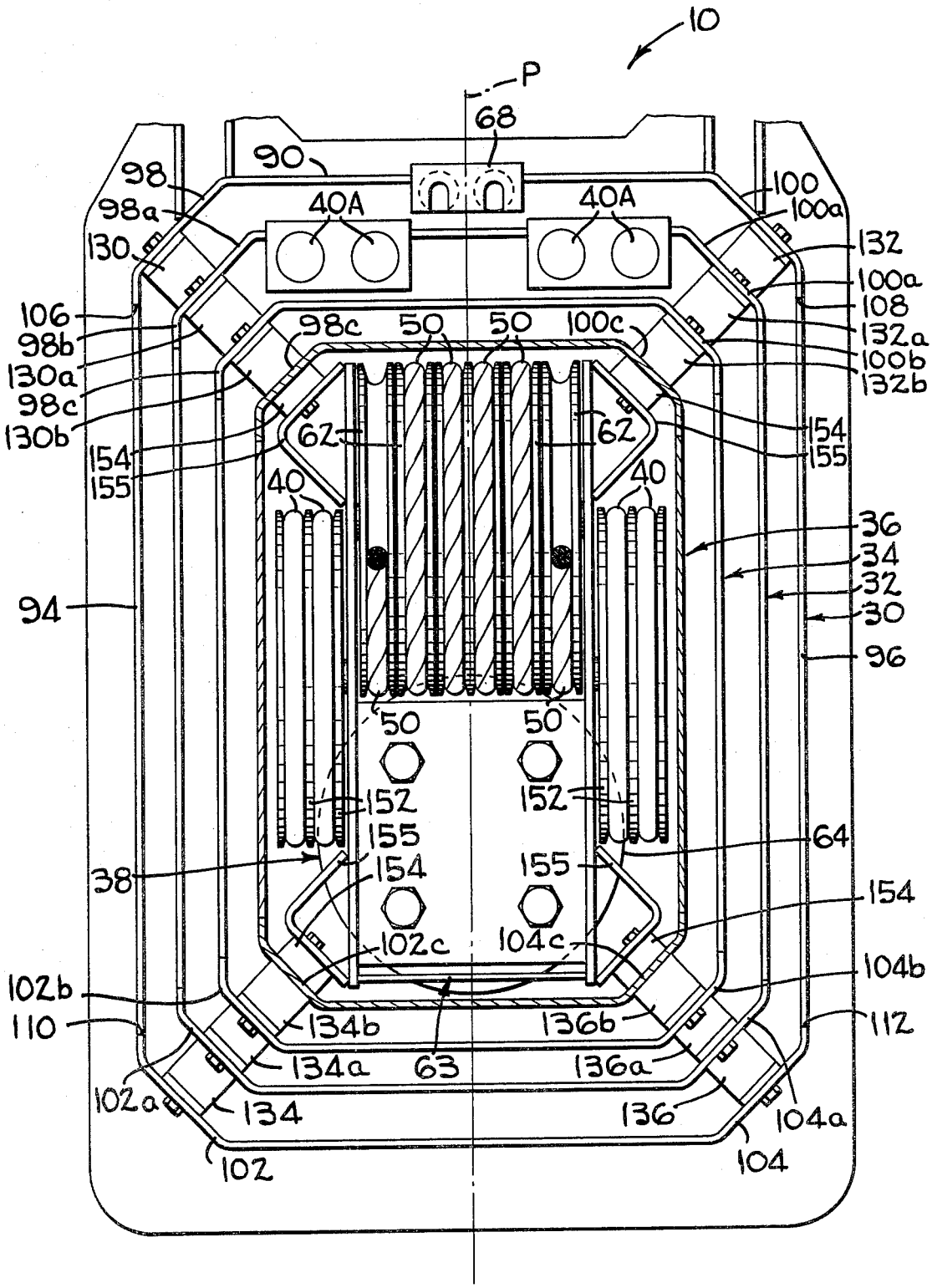
FIG. 3 is a diagrammatic section taken along lines 3—3 of FIG. 2 illustrating the transverse cross-section of the boom.

The boom 10 is preferably extended and retracted by a single hydraulic ram 38 (FIG. 2) aided by two pair of extend cables 40 and retract cables 40A (FIGS. 2 and 3). The manual section 32 is selectively locked in a retracted position or in one of a plurality of extended positions, to the base section 30 during different phases of the boom extension and retraction operation by means not shown. The piston rod 42 of the ram 38 is selectively connected to the manual section 32 or to the base section 30 by a coupling mechanism (not shown).

The preferred structure for supporting the boom 10 (FIG. 1) about axis B is accomplished by means of a pair of pendant lines 50 which are trained around sheaves 52 journaled on the outer end of the base section 30 (FIG. 1), around sheaves 54 journaled on the upper end of a live mast 56, and around sheaves 58 journaled on the head machinery 37. The pendant lines 50 then enter the tubular boom, and engage the under surface of sheaves 62. The pendant lines are then trained around sheaves 60 journaled on the inner end of the tip section 36, back around the triple groove sheaves 62 journaled on a bracket 63 secured to the outer end of the cylinder case 64 of the ram 38, around sheaves 66 journaled on the rear end of the manual section 32 and are then anchored to the outer end of the base section at 68. The other ends of the pendant lines 50 are anchored to the base section 30 at 70 (FIG. 1). The boom 10 is raised and lowered by controled operation of the winch 22 which is connected to the upper end of the live mast 56 by a boom hoist line 72. This boom elevating structure is described in more detail in the aforementioned Cozad application, which application is incorporated by reference herein.

The specific details of the structure for extending and retracting the boom sections, and for locking the sections to one another as above described are fully disclosed in the aforementioned Rathe application which application is incorporated by reference herein.

An important feature of the present invention is the configuration of the structure for supporting the tubular, telescopic boom sections 30,32,34,36 (FIGS. 1 and 2) for extension and retraction relative to each other while maintaining the longitudinal axis of each boom section aligned with a vertical plane P (FIG. 3) containing the longitudinal axis of the base section even when substantial side forces are being applied to the section 36 by a suspended load.

In the preferred embodiment of the invention and as best shown in FIG. 3, the base section 30 of the boom 10 includes an upper wall 90, a lower wall 92, a pair of spaced side walls 94,96, a pair of upper angled corner plates 98, 100 which connect the upper wall 90 to the side walls 94, 96, and a pair of lower angled corner plates 102,104 which connect the lower wall 92 to the side walls 94,96. The upper wall 90 and angle corner plates 98,100 are preferably formed integrally from a single plate with outer edge portions 106,108 directed downwardly and welded to the side walls 94,96. Similarly, the lower wall 92 and lower angled corner plates 102,104 are preferably formed integrally from a single plate with the outer edge portions 110,112 bent upwardly and welded to the side walls 94,96. It will be appreciated that the preferred construction of the upper and lower walls minimize the amount of welding required and also eliminates welds in the highly stressed corners.

The upper angle corner plates 98,100 converge upwardly and inwardly at the same angle but in opposite directions toward the vertical plane P. The lower angle corner plates 102,104 converge downwardly and inwardly at the same angle but in opposite directions toward the plane P.

The cross-sectional construction of the manual section 32, the mid section 34 and the tip section 36 are substantially the same as the base section except that the boom sections are progressively smaller in cross-section. Accordingly, the cross-sectional construction of the manual section 32, the mid section 34 and the tip section 36 will not be described in detail but parts of these sections which are equivalent to those of the base section 30 will be identified by the same numerals followed by the letters "a", "b" and "c", respectively.

Figure 4:
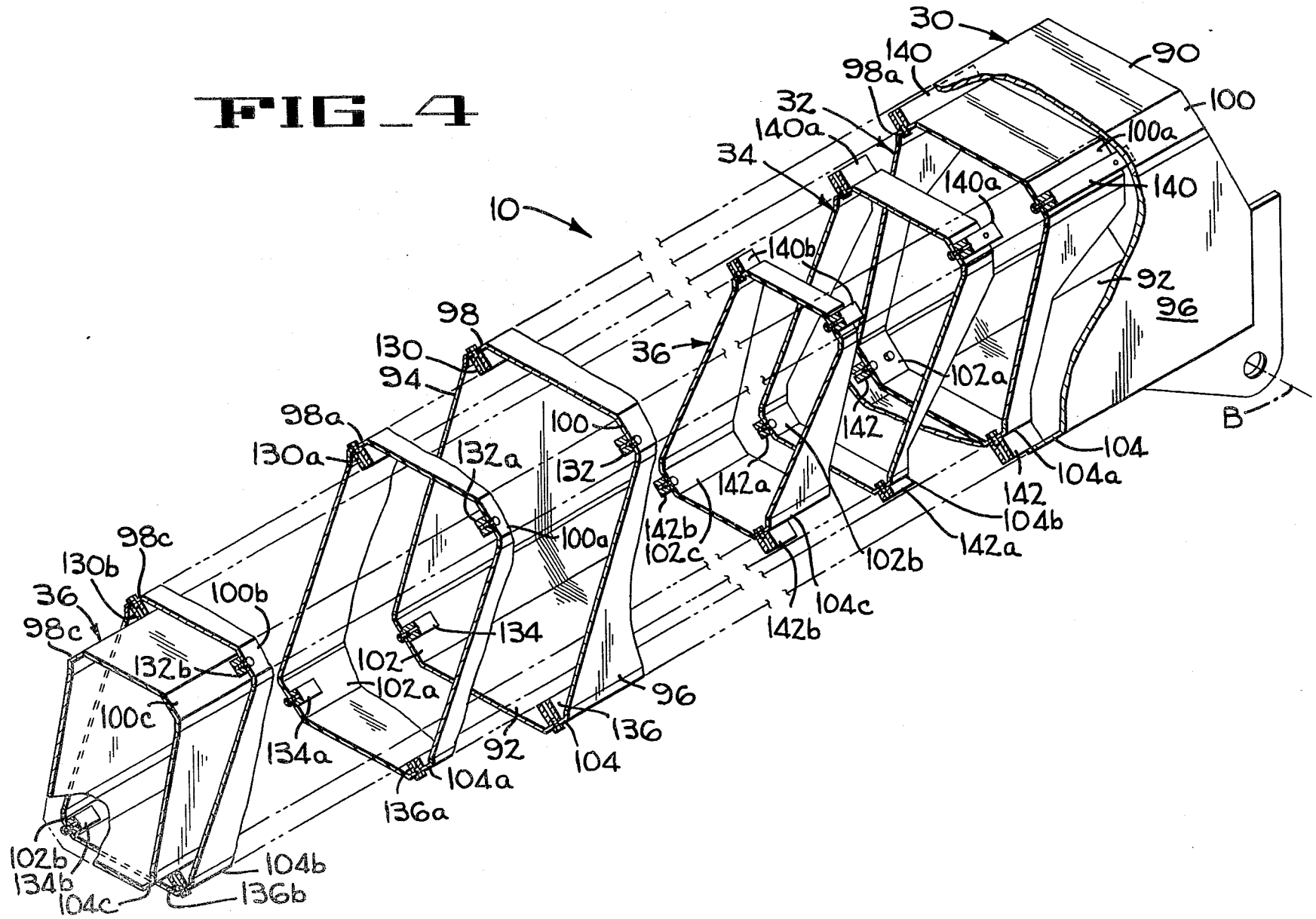
FIG. 4 is a perspective view of the boom sections, with portions being broken away, illustrating the relationship of the boom shoes with angled corners of the boom sections.

Having reference to FIGS. 2, 3 and 4, upper outer boom shoes 130,132 and lower outer boom shoes 134,136 are rigidly secured near the outer end of the base section 30 as by bolting to the inner surfaces of the upper angle corner plates 98,100 and to the lower angle corner plates 102,104, respectively. These boom shoes 130,132,134,136 slidably engage the outer surfaces of the angle corner plates 98*a*, 100*a*, 102*a*, 104*a* of the manual section 32, respectively.

Other outer boom shoes 130*a*, 132*a*, 134*a* and 136*a* are rigidly secured to the inner surfaces of the angle corner plates 98*a*,100*a*, 102*a* and 104*a*, respectively near the outer end of the manual section 32 and slidably engage the outer surfaces of the angled corner plates 98*b*,100*b*, 102*b* and 104*b*, respectively. Similarly, boom shoes 130*b*, 132*b*, 134*b* and 136*b* are rigidly secured to the inner surfaces of the angled corner plates 98*b*, 100*b*, 102*b* and 104*b*, respectively, and slidably engage the outer surfaces of the angled corner plates 98*c*, 100*c*, 102*c*, and 104*c*, respectively.

Similar pairs of upper and lower boom shoes 140, 142; 140*a*,142*a*; and 140*b*,142*b* (FIG. 4) are located near the rear of the boom sections. The rear shoes are bolted to outer surfaces of the angled corners and slidably engage the inner surface of the adjacent angle plates of the next largest boom section.

More particularly, upper rear shoes 140 are bolted to the outer surfaces of the angled corner plates 98*a*, 100*a* (FIG. 3) of the manual section 32 and slidably engage the inner surfaces of the angled corner plates 98,100 of the base section 30, the two lower shoes 142 are bolted to the outer surface of the angle corner plates 102*a*, 104*a* (FIG. 3) of the manual section 32 and slidably engage the inner surfaces 102,104 of the base section 30.

The upper and lower shoes 140*a*, 142*a* (FIG. 2) are secured to the outer surfaces of the upper and lower angle corner plates 98*b*,100*b* and 102*b*, 104*b*, respectively, near the rear end of the mid section 34 and slidably engage the inner angled corner surfaces of the next larger boom section, i.e., the manual section 32.

The upper and lower shoes 140*b* and 142*b* are likewise secured to the outer surfaces of the upper and lower angled plates 98*c*, 100*c* and 102*c*, 104*c* respectively, near the end of the tip section 34 and slidably engage the inner angled corner surfaces of the mid section 34.

As illustrated in FIG. 3, the bracket 63 is pinned to the outer end of the ram 38 and has the aforementioned pendant sheaves 62 and extend line sheaves 152 journaled thereon. Four ram alignment shoes 154 are bolted to the angle bracket 155 and slidably engage the inner surfaces of the angled shoe contacting plates 98*c*, 100*c*, 102*c* and 104*c* of the tip section.

In operation, the boom 10 (FIG. 1) is pivotally raised and lowered about pivot axis B by means of the pendant lines 50, boom hoist line 72 and actuation of the winch 22 in the proper direction. The boom is pivoted about vertical axis A of bearing 20 by conventional means (not shown); the boom 10 is extended and retracted upon actuation of the hydraulic ram 38; and a load L may be connected to the load line 24A for suspension from the boom. All of the above operations are performed under the control of an operator.

With the boom extended and supporting load L, it will be appreciated that the lower outer shoes 134, 134*a*, 134*b* and 136, 136*a*, 136*b* will act like inclined planes causing the outer surfaces of the angled corner plates 102*a*, 102*b*, 102*c* and 104*a*, 104*b*, 104*c* to slide downwardly and toward the central vertical plane P thereby compensating for clearance and shoe wear at the forward or outer end of all of the boom sections causing the forward portion of all boom sections to remain centered on the plane P.

The rear pairs of upper shoes 140, 140*a*, 140*b* (FIG. 4) at the rear ends of the manual section 32, mid section 34 and tip section 36 will be forced upwardly due to the load L suspended from the tip section. The angled corner plates 98,100 of the base section, the angled corner plates 98*a*, 100*a* of the manual section 30, and the angled corner plates 98*b*, 100*b* of the mid section 34 will also act as inclined planes which cause the rear end of the sections to slide upwardly and toward the center of the vertical plane P thereby compensating for clearance and wear to the rear shoes.

With the upper shoes at the rear end of the boom sections raised upwardly against the associated angled corner plates, and with the lower angled corner plates engaging the associated inclined shoes on the outer ends of the boom sections 30,32 and 34, all boom sections remain in horizontal transverse alignment with their axes within or substantially within the vertical plane P even though substantial side forces are applied to the tip section of the boom.

Although the angled corner sections of the preferred embodiment have been illustrated as being integral with the associated upper or lower walls, it will be understood that the corner plates may be otherwise connected to the adjacent walls as desired.

From the foregoing description it is apparent that the boom construction of the present invention provides boom shoes secured to angled corner plates and slidably engaging other angled boom sections at the bottom of the forward end of the boom which compensates for clearance and shoe wear thereby maintaining the forward end of the boom sections in alignment with a vertical plane; and that a similar construction at the upper rear end of the boom sections maintains the rear portions of the boom sections in alignment with said vertical plane. If the boom is not subjected to a load sufficient to raise the rear end of the boom sections or if the geometry of the boom system and the resultant vertical forces result in the rear end of the boom dropping and the front end of the boom raising relative to the next section, the lower shoes at the rear end of the boom sections will maintain alignment with the vertical plane.

Although the best mode contemplated for carrying out the present invention has been shown and described, it will be apparent that modification and variation may be made without departing from what is regarded to be the subject matter of the invention.

What is claimed is:

1. An apparatus for maintaining telescopic boom sections having inner and outer ends in alignment relative to a vertical plane when loaded and subjected to a side force comprising: means in a large cross-sectioned boom section defining upper angle corner plates having parallel inner and outer planar surfaces converging upwardly and inwardly at the same angle relative to a central vertical plane containing the longitudinal axis of said large boom section, means in said large cross-sectioned boom section defining lower angle corner plates having parallel inner and outer planar surfaces converging inwardly and downwardly at the same angle relative to said central plane, first bearing means secured to the inner end of a smaller cross-sectioned boom section in position to movably engage only said inner planar surfaces of said upper angle corner plates of said large cross-sectioned boom section, means in said smaller boom section defining lower angled corner plates having parallel inner and outer planar surfaces converging inwardly and downwardly at the same angle relative to said plane, and second bearing means secured to the inner surface of said lower corner plates of said large boom section near its outer end in position to movably engage only said outer planar surfaces of said lower angle corner plates of said smaller boom section.

2. An apparatus according to claim 1 wherein said inner planar surfaces and said outer planar surfaces of each angled corner plate, are at the same angle relative to said vertical plane, said first and second bearing means and cooperating angled surfaces acting as inclinded planes maintaining the axes of said sections in said vertical plane when loaded and subjected to the side load.

3. An apparatus according to claim 2 wherein said same angle is 45° relative to said plane.

4. An apparatus according to claim 1 wherein said first and second bearing means are boom shoes which slidably engage only said inner planar surfaces of said large boom section and the outer planar surface of said small boom section, respectively.

5. An apparatus according to claim 1 and additionally comprising power means connected to said large and small tubular sections for selectively extending and retracting said boom sections while loaded and subjected to said side load.

6. An apparatus according to claim 1 wherein said telescopic boom is a crane boom, wherein each boom section is generally rectangular in shape, and wherein said first and second bearing means and said cooperating inner or outer planar angled surfaces act as inclined planes maintaining the axes of said boom sections in said vertical plane when loaded and subjected to a side load.

7. An apparatus for maintaining telescopic boom sections of progressively smaller tubular cross-sections and having inner and outer ends in alignment relative to a vertical plane when loaded and subjected to a side force comprising: means in all boom sections defining upper angled corner plates and lower angled corner plates each having parallel inner and outer planar surfaces converging upwardly and inwardly, and downwardly and inwardly at the same angles, respectively, relative to a central vertical plane containing the longitudinal axis of said large boom section; first bearing means secured to each of said outer planar surfaces adjacent the inner end of all except the largest boom section for movably engaging only said parallel inner planar surfaces of the adjacent angled corner sections of the next larger boom section; and second bearing means secured to each of said inner planar angled surfaces adjacent the outer ends of all except the smallest boom sections for movably engaging only said outer planar surfaces of said angled corner sections of the next smaller boom section.

8. An apparatus according to claim 7 wherein said angled plates are all at an angle of approximately 45° relative to said vertical plane.

9. An apparatus according to claim 7 and additionally comprising power means operatively connected to said boom sections for selectively extending or retracting said sections when the boom is loaded and a side force is being applied to the boom.

10. An apparatus according to claim 7 wherein each angled corner plate extends substantially the full length of the associated boom section.

11. An apparatus according to claim 7 or 6 wherein said largest boom section is the base section of a crane boom, wherein the next adjacent section is the manual section, and wherein the smallest section is the tip section of the boom.

12. An apparatus according to claims 7 or 6 wherein said first and second bearing means are boom shoes which slidably engage said inner surfaces of the adjacent angled corner plates of the adjacent boom sections, and said outer surfaces of adjacent angled corner plates of the next smaller adjacent boom sections, respectively.

13. In an extensible telescopic boom having an inner and an outer end for a crane or the like including a boom defined by a plurality of tubular boom sections including a first section of large cross-sectional configuration and a second section of smaller cross-sectional configuration each having longitudinal axes normally lying in a longitudinally extending vertical plane and adapted to be subjected to a load including side forces tending to misalign the axis of said smaller boom section with said plane, and means operatively connected to said boom sections for extending and retracting at least said smaller section relative to said large section, the improvement which comprises: means included in said large and small boom sections defining pairs of upper corner plates having parallel inner and outer planar surfaces converging upwardly and inwardly toward said vertical plane at equal but opposite angles, means included in said large and smaller sections defining pairs of lower corner plates having parallel inner outer planar surfaces converging downwardly and inwardly toward said plane at equal but oppositely directed angles, first boom bearing means rigidly secured to the inner surfaces of the corner plates of said large boom section near the outer end thereof for movably engaging only the outer surface of associated corner plates of said smaller boom section, and second boom bearing means rigidly secured to the outer surfaces of the corner plates of said smaller boom section near the rear end thereof for movable engagement only with the inner surfaces of the associated corner plates of the large boom section, said movable engagement between said front lower shoes and said associated corner surfaces of said second boom section and said movable engagement between said rear upper shoes and said first boom section maintaining alignment of said longitudinal axes in said vertical plane when the boom is loaded and is subjected to a side force.

* * * * *